United States Patent [19]

Fitch

[11] Patent Number: 4,457,271

[45] Date of Patent: Jul. 3, 1984

[54] AUTOMATICALLY-CONTROLLED GASEOUS FUEL PRIMING SYSTEM FOR INTERNAL COMBUSTION ENGINES

[75] Inventor: Ralph H. Fitch, West Allis, Wis.

[73] Assignee: Outboard Marine Corporation, Waukegan, Ill.

[21] Appl. No.: 404,240

[22] Filed: Aug. 2, 1982

[51] Int. Cl.[3] ..... F02N 17/00

[52] U.S. Cl. ..... 123/187.5 R; 123/179 G; 261/DIG. 8

[58] Field of Search ..... 123/187.5 R, 187.5 P, 123/179 G; 261/DIG. 8, 39 D

[56] References Cited

U.S. PATENT DOCUMENTS

| | | | |
|---|---|---|---|
| 1,085,425 | 1/1914 | Hobe et al. | 261/DIG. 8 |
| 1,404,152 | 1/1922 | Kettering et al. | 123/187.5 R |
| 1,837,298 | 12/1931 | Starr . | |
| 2,896,599 | 7/1959 | Ensign . | |
| 2,945,483 | 7/1960 | Howell . | |
| 2,985,159 | 5/1961 | Moseley . | |
| 3,190,277 | 6/1965 | Tessier . | |
| 3,614,945 | 10/1971 | Schlagmuller et al. . | |
| 3,646,924 | 3/1972 | Newkirk et al. . | |
| 3,827,417 | 8/1974 | Morita | 123/187.5 R |
| 3,960,131 | 6/1976 | Davis . | |

FOREIGN PATENT DOCUMENTS

| | | | |
|---|---|---|---|
| 1210249 | 2/1966 | Fed. Rep. of Germany | 123/187.5 R |
| 723617 | 2/1955 | United Kingdom | 123/187.5 R |

*Primary Examiner*—Parshotam S. Lall
*Attorney, Agent, or Firm*—Michael, Best & Friedrich

[57] ABSTRACT

The priming system for an internal combustion engine adapted to operate on a gaseous fuel includes a normally closed, solenoid-operated priming valve electrically connected to the engine ignition circuit through a selector switch and the normally closed contacts of a vacuum switch when the selector switch is an "automatic" position. The priming valve controls a small flow of the gaseous fuel into the air intake of the engine carburetor. The vacuum switch has a pressure-sensing chamber which is connected in fluid communication with the engine intake manifold. When an operator moves the engine ignition switch to a start position with the selector in the "automatic" position, the priming valve is energized open to admit a small flow of the gaseous fuel into the carburetor air intake for priming. When the pressure in the engine intake manifold decreases below a predetermined level during engine cranking, the vacuum switch opens to deenergize the priming valve which closes to terminate the flow of priming fuel. If over priming occurs, the operator can move the selector switch of an "off" position which electrically disconnects the priming valve from the ignition circuit and causes the priming valve to close. In a preferred embodiment, the selector switch is also movable to a "manual" position wherein the priming valve is momentarily electrically connected to an electrical power source.

11 Claims, 2 Drawing Figures

AUTOMATICALLY-CONTROLLED GASEOUS FUEL PRIMING SYSTEM FOR INTERNAL COMBUSTION ENGINES

BACKGROUND OF THE INVENTION

This invention relates to internal combustion engines adapted to operate on either a liquid fuel or a gaseous fuel and, more particularly, to gaseous fuel priming systems for such engines.

Prior internal combustion engines adapted to operate either on a liquid fuel, such as gasoline, or a gaseous fuel, such as compressed natural gas, usually include a manually operated system for priming the engine with a small amount of the gaseous fuel to facilitate starting. Such manual priming systems require some experience by the operator before he learns how to use them to provide the proper amount of priming for easier engine starting.

Attention is directed to the following U.S. Patents:

| Patentee | U.S. Pat. No. | Issue Date |
|---|---|---|
| Starr | 1,837,298 | December 22, 1931 |
| Ensign | 2,896,599 | July 28, 1959 |
| Howell | 2,945,483 | July 19, 1960 |
| Moseley | 2,985,159 | May 23, 1961 |
| Tessier | 3,190,277 | June 22, 1965 |
| Schlagmuller et al | 3,614,945 | October 26, 1971 |
| Newkirk et al | 3,646,924 | March 7, 1972 |
| Davis | 3,960,131 | June 1, 1976 |

SUMMARY OF THE INVENTION

The invention provides an internal combustion engine including an electric starter, an engine electrical circuit connecting the starter to an electrical power source having an ignition switch, a carburetor having an air intake, and a supply means for selectively admitting gaseous fuel into the carburetor intake and including a priming system for initiating a small flow of the gaseous fuel into the carburetor air intake to prime the engine in response to movement of the ignition switch to a start position and for terminating the flow of priming fuel in response to starting operation of engine.

In one embodiment, the priming system includes an electrically actuated priming valve which is movable between an open position to admit flow of priming fuel and a closed position to terminate flow of priming fuel and which is electrically connected in the engine electrical circuit for actuation to the open position when the ignition switch is moved to the start position and for movement to the closed position in response to starting operation of the engine.

In one embodiment, the priming system includes a pressure-actuated switch connected in fluid communication with the engine intake manifold and connected in the engine electrical circuit through normally closed contacts to electrically connect the priming valve with the ignition switch and to electrically disconnect the priming valve from the engine electrical circuit when the contacts open in response to the pressure in the engine intake manifold decreasing below a predetermined value during engine operation.

In one embodiment, the priming system includes an electrical selector switch connected in the engine electrical circuit to electrically connect the priming valve with the ignition switch when in a first or "automatic" position and to electrically disconnect the priming valve from the ignition switch and from the electrical power source when in a second or "off" position. The selector switch can be further movable to a third or "manual" position wherein the priming valve is momentarily electrically connected to the electrical power source.

A principal feature of the invention is the provision of an internal combustion engine which is adapted to operate on a gaseous fuel and also includes a priming system for admitting a small flow of the gaseous fuel into the engine carburetor air intake to prime the engine during starting.

Another of the principal features of the invention is the provision of such an internal combustion engine including such a priming system which automatically initiates the flow of priming fuel in response to movement of the engine ignitiion switch to a start position and terminates the flow of priming fuel in response to starting operation of the engine.

A further of the principal features of the invention is the provision of such an internal combustion engine including such a priming system which is further adapted to permit the operator to manually prime the engine.

Other features, aspects and advantages of the invention will become apparent to those skilled in the art upon reviewing the following description, the drawing and the appended claims.

DESCRIPTION OF THE PREFERRED EMBODIMENTS

Figure 1:
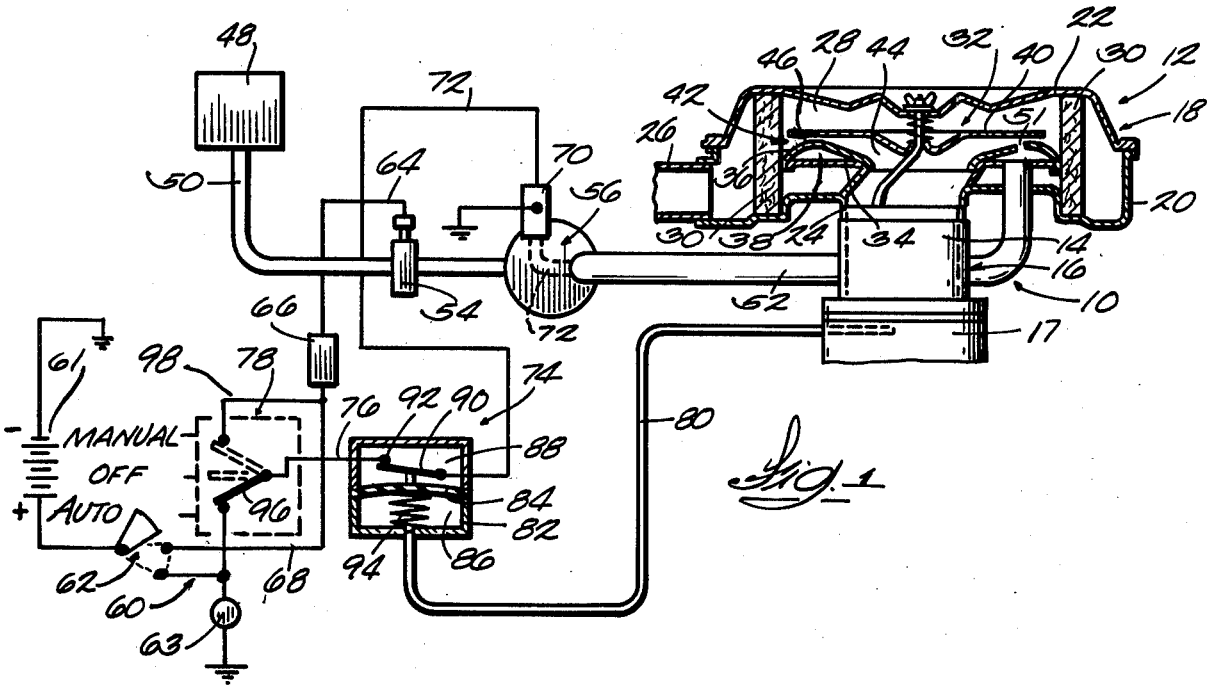
FIG. 1 is a fragmentary and partially diagramatic illustration of an internal combustion engine embodying various of the features of the invention.

Fragmentarily and diagrammatically illustrated in FIG. 1 is an internal combustion engine 10 including an air cleaner 12 mounted on an air intake 14 of a conventional carburetor 16. As is common practice, the carburetor 16 includes a pivotally mounted throttle plate (not shown) and is mounted in communication with an engine intake manifold 17.

The air cleaner 12 includes a housing 18 including a bowl-like bottom section 20 and a removable top section or cover 22. The bottom section 20 includes a generally central sleeve portion 24 for receiving the carburetor air intake 14. The air cleaner 12 also includes an air inlet duct 26 through which atmospheric air is admitted into an interior chamber 28 defined by the bottom section 20 and the cover 22. Located inside the chamber 28 is a conventional filter element 30 through which the air flows enroute from the inlet duct 26 to the carburetor air intake 14.

Disposed inside the chamber 28 is proportioning device 32 for mixing air and a gaseous fuel, such as compressed natural gas. The proportioning device 32 includes an annular base member 34 and an annular member 36 which has an arcuate wall and which is fastened to the base member 34 to define a substantially closed plenum chamber 38.

The proportioning device 32 includes a plate or disc-like member or top 40 which is mounted in spaced relationship to the arcuate wall of the annular member 36 and cooperates therewith to form an annular venturi designated generally by reference numeral 42. The annular venturi 42 has an annular inlet in communication with the atmosphere via the filter element 30 and the air inlet duct 26, an annular outlet in communication with a mixing chamber 44, and an intermediate annular throat 46 in the area of minimum space between the arcuate wall of the annular member 38 and the top 40. When the engine is operating on liquid fuel, such as gasoline, the flow area for air to the carburetor air intake 14 is a cross sectional area of the annular throat 46 of the venturi 42.

The gaseous fuel is admitted into the plenum chamber 38 from a source, such as a pressurized tank 48, through a supply conduit or line 50 and an inlet conduit or pipe 52 connected in fluid communication with the plenum chamber 38. The gaseous fuel flows from the plenum chamber 38 into the mixing chamber 44 through a plurality of openings 51 (one shown) in the arcuate wall of the annular member 36 at or in the vicinity of the annular venturi throat 46. The flow of gaseous fuel to the plenum chamber 38 is controlled by a suitable shutoff valve, such as a normally closed, solenoid-operated valve 54 and a conventional three-stage compressed gas regulator 56 (illustrated schematically). The regulator 56 is arranged in a conventional manner to meter the flow of the gaseous fuel through the inlet pipe 52 into the plenum chamber 38.

The engine 10 has an electrical ignition circuit 60 (illustrated diagramatically) which is electrically connected to a suitable source of electrical power 61, such as a 12-volt battery. The ignition circuit 60 includes a conventional, three-position ignition switch 62 connected in series with a conventional electric starter motor 63 and movable between off, on and start positions.

The shut-off valve 54 is electrically connected to the ignition switch 62 via an electrical lead 64, an operating mode selector means 66, and an electrical lead 68. The shut-off valve 54 can be a separate valve as shown or located internally in the regulator 56. The operating mode selector means 66 is movable to a gaseous fuel operating position wherein the shut-off valve 54 is energized to the open position when the ignition switch 62 is moved to the on position or the start position illustrated by the dashed lines.

When the engine 10 is operating on the gaseous fuel, the flow of the gaseous fuel from the plenum chamber 38 is induced into the mixing chamber 44 by air flowing through the annular venturi 42 toward the mixing chamber 44. The reduced pressure condition created in the vicinity of the annular venturi throat 46, where the highest flow velocity exists, draws the gaseous fuel from the plenum chamber 38 through the openings 51 and into the mixing chamber 44.

A priming system is provided for initiating a small flow of gaseous fuel into the carburetor air intake 14 to prime the engine in response to moving the ignition switch 62 to the start position and for terminating flow of the priming fuel in response to starting operation of the engine. In the specific construction illustrated, the priming system includes a normally closed, solenoid-operated priming valve 70 which controls flow through a by-pass conduit 72 in the regulator 56. The by-pass conduit 72 is arranged to provide a small predetermined flow of the gaseous fuel directly from the first stage of the regulator 56 or the supply line 50 to the inlet line 52 prior to the time the engine fires. This flow of gaseous fuel serves to prime the engine. If desired, a priming fuel line completely separate from the inlet line 52 can be provided.

The priming valve 70 is electrically connected to the ignition switch 62 via an electrical lead 72, a conventional vacuum switch 74, an electrical lead 76, and a selector control switch 78. Electrical power can not be supplied to the priming valve 70 when the ignition switch 62 is in the off or on positions, but can be when the ignition switch 62 is in the start position. The vacuum switch 74 is connected in fluid communication with the engine intake manifold 17 via a conduit 80 and is arranged to interrupt the electrical circuit between the priming valve 70 and the control switch 78 in response to pressure in the engine intake manifold 17 decreasing below a predetermined level during engine cranking.

In the specific construction illustrated, the vacuum switch 74 includes a housing 82 and a diaphragm 84 inside the housing 82 defining a pressure-sensing chamber 86 and a chamber 88 open to the atomsphere. The diaphragm 84 carries an actuator 90 which is biased to a closed position in engagement with switch contacts 92 (as illustrated by solid lines) by a spring 94 located inside the pressure-sensing chamber 86 and bearing against the bottom side of the diaphragm 84. The conduit 80 connects the pressure-sensing chamber 86 in fluid communication with the engine intake manifold 17. When the pressure inside the engine intake manifold 17, and thus the pressure inside the pressure-sensing chamber 86, decreases to a level where the pressure force acting on the top side of the diaphragm 84 is greater than the combined pressure force and spring force acting on the bottom side of the diaphragm 84, the diaphragm 84 is moved downwardly and the switch actuator 90 is disengaged from the switch contacts 92 to interrupt electrical current to the priming valve 70.

The control switch 78 includes an arm 96 which is movable between a first or "automatic" position wherein the vacuum switch 74 is electrically connected to the ignition switch 62 via the electrical lead 76 and a second or "off" position wherein the vacuum switch 84 is electrically disconnected from the ignition switch 62 and the electrical power source 61.

The control switch arm 94 may be arranged to the movable to a third or a "manual" position wherein the vacuum switch 84 is electrically connected to the electrical power source 61 via an electrical lead 98. In this case, the arm 94 preferably is arranged to be momentarily movable to the "manual" position. For example, the arm 94 could be spring biased toward the "off" position.

When the control switch 78 is in the "automatic" position, the priming valve 70 is electrically connected to the ignition switch 62 through the normally closed contacts 92 of the vacuum switch 74. When an operator moves the ignition switch 62 to the start position, the starter motor 63 is started via a relay (not shown) and the priming valve 70 is simultaneously energized to the open position to permit a small flow of the gaseous fuel to be introduced into the carburetor air intake 14. The pressure in the engine intake manifold 17 decreases as the engine commences cranking. When this pressure decreases to a predetermined level corresponding to the pressure setting of the vacuum switch 74, the vacuum switch 74 moves to the open position to interrupt the flow of electrical current to the priming valve 70, causing it to return to the normally closed position and terminate the flow of priming fuel.

The vacuum switch 74 may be set at a pressure where it is actuated to open either during initial cranking before the engine fires or after the engine has fired.

If the engine does not fire right away and appears to be over primed, the operator can terminate priming by moving the control switch 78 to the "off" position. The operator normally will keep the control switch 78 in the "automatic" position for starting, but can manually prime the engine, when desired, by momentarily moving the control switch 78 to the "manual" position.

Figure 2:
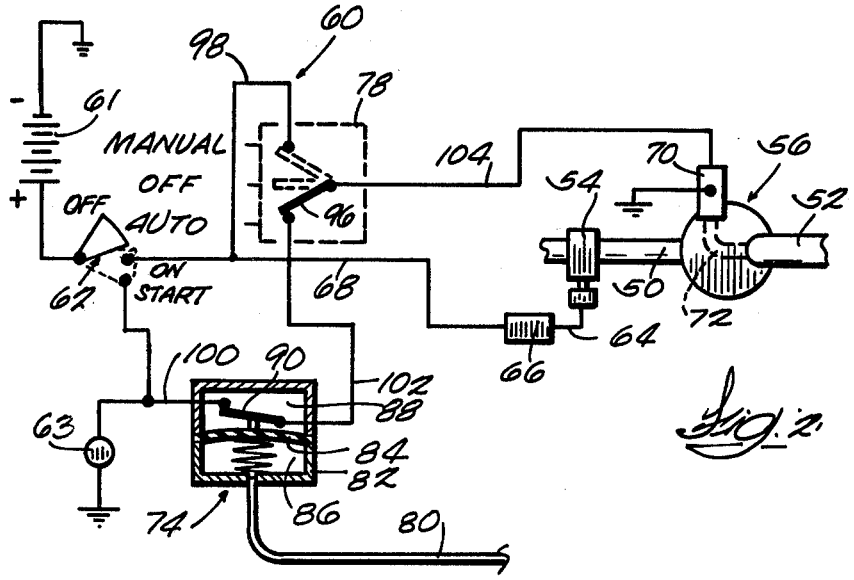
FIG. 2 is a fragmentary and diagramatic illustration of an alternate arranement of the control for the engine priming system shown in FIG. 1.

In the alternate embodiment ilustrated in FIG. 2, the vacuum switch 74 is connected in the electrical circuit 60 so that the engine can be manually primed in the event the vacuum switch 74 fails. More specifically, the vacuum switch 74 is electrically connected in series with the ignition switch 62 and between the ignition switch 62 and the control switch 78 via electrical leads 100 and 102. The priming valve 70 is electrically connected directly to the control switch 78 by an electrical lead 104.

When the control switch 78 is in the "manual" position, the priming valve 70 is energized directly from the electrical power source 61 independently of the vacuum switch 74.

Various of the features of the invention are set forth in the following claims:

I claim:

1. An internal combustion engine including an electrical starter for starting said engine, an electrical circuit interconnecting said starter with a source of electrical power, an ignition switch connected in said electrical circuit and selectively movable to a start position to supply electrical power to said starter, a carburetor having an air intake, and supply means for selectivley admitting gaseous fuel into said carburetor air intake, said supply means including a priming system for initiating a small flow of the gaseous fuel into said carburetor air intake to prime said engine in response to movement of said ignition switch to the start position and for terminating said flow of priming fuel in response to said engine commencing to operate after ignition.

2. An internal combustion engine according to claim 1 wherein said priming system includes an electrically actuated priming valve movable between an open position to admit said flow of priming gaseous fuel and a closed position to terminate said flow of priming gaseous fuel, said priming valve being connected in said electrical circuit for actuation to the open position when said ignition switch is moved to the start position and for movement to the closed position in response to said engine commencing to operate after ignition.

3. An internal combustion engine according to claim 2 wherein said engine includes an intake manifold in which a low pressure condition is created during engine cranking, and wherein said priming system includes a pressure-actuated switch movable from a first position to a second position in response to sensing a pressure below a predetermined level, said pressure-actuated switch being connected in fluid communication with said intake manifold and connected in said electrical circuit to electrically connect said priming valve with said ignition switch when in the first position and to electrically disconnect said priming valve from said electrical circuit when moved to the second position in response to the pressure in said engine intake manifold decreasing below said predetermined value.

4. An internal combustion engine according to claim 3 wherein said priming system includes an electrical control switch selectively movable between a first position and a second position, said control switch being connected to said electrical circuit to electrically connect said priming valve with said ignition switch when in the first position and to electrically disconnect said priming valve from said ignition switch and from said electrical power source when in the second position.

5. An internal combustion engine according to claim 4 wherein said control switch is further momentarily movable to a third position and is further connected in said electrical circuit to momentarily electrically connect said priming valve with said electrical power source when in the third position.

6. An internal combustion engine according to claim 5 wherein said pressure-actuated switch is electrically connected in said electrical circuit between said ignition switch and said priming valve such that said priming valve is momentarily electrically connected to said electrical power souce independently of said pressure-actuated switch when said control switch is in the third position and said priming valve is electrically connected to said ignition switch through said pressure-actuated switch when said control switch is in the first position.

7. An internal combustion engine according to claim 4 wherein said pressure-actuated switch is connected in said electrical circuit between said control switch and said priming valve.

8. An internal combustion engine including an intake manifold in which a low pressure condition is created during engine cranking, an electric starter for starting said engine, an electrical circuit interconnecting said electric starter with a source of electrical power, an ignition switch connected in said electric circuit and selectively movable to a start position to supply electrical power to said starter, a carburetor having an air intake, supply means for selectively admitting gaseous fuel into said carburetor air intake and including a priming system, said priming system including an electrically actuated priming valve movable between an open position to admit a small flow of the gaseous fuel into the carburetor air intake and a closed position to terminate said flow of gaseous fuel, said priming system further including a pressure-actuated switch movable from a first position to a second position in response to sensing a pressure below a predetermined level, said pressure-actuated switch being connected in fluid communication with said engine intake manifold and connected in said electrical circuit to electrically connect said priming valve with said ignition switch when said pressure-actuated switch is in the first position and to electrically disconnect said priming valve from said electrical circuit when said pressure-actuated switch is moved to the second position in response to the pressure in said engine intake manifold decreasing below said predetermined value, and an electrical control switch selectively movable between a first position and a second position, said control switch being connected in said electrical circuit to electrically connect said priming valve with said ignition switch when in the first position and to electrically disconnect said priming valve from said ignition switch and said electrical power source when in the second position.

9. An internal combustion engine according to claim 8 wherein said pressure-actuated switch is further momentarily movable to a third position and is further connected in said electrical circuit to momentarily electrically connect said priming valve with said electrical power source when in the third position.

10. An internal combustion engine according to to claim 9 wherein said pressure-actuated switch is electrically connected in said electrical circuit between said control switch and said priming valve.

11. An internal combustion engine according to claim 9 wherein said pressure actuated switch is electrically connected in said electrical circuit between said ignition switch and said priming valve such that said priming valve is momentarily electrically connected to said electrical power source independently of said pressure-actuated switch when said control switch is in the third position and said priming valve is electrically connected to said ignition switch through said pressure-actuated switch when said control switch is in the first position.

* * * * *